US008204421B2

(12) United States Patent
Hiraoka et al.

(10) Patent No.: US 8,204,421 B2
(45) Date of Patent: Jun. 19, 2012

(54) FUSING APPARATUS AND IMAGE FORMING APPARATUS

(75) Inventors: Chikara Hiraoka, Osaka (JP); Yoshihiro Fukuhata, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 12/753,409

(22) Filed: Apr. 2, 2010

(65) Prior Publication Data

US 2010/0260524 A1 Oct. 14, 2010

(30) Foreign Application Priority Data

Apr. 8, 2009 (JP) ..... 2009-094011

(51) Int. Cl.
*G03G 15/20* (2006.01)

(52) U.S. Cl. ..... 399/329; 399/122

(58) Field of Classification Search ..... 399/107, 399/110, 122, 320, 328, 329; 219/216, 619
See application file for complete search history.

(56) References Cited

U.S. PATENT DOCUMENTS

| | | | | |
|---|---|---|---|---|
| 7,418,229 | B2 * | 8/2008 | Aruga et al. | 399/329 |
| 7,664,447 | B2 | 2/2010 | Yagi et al. | |
| 7,831,186 | B2 * | 11/2010 | Obata et al. | 399/328 |
| 2007/0223976 | A1 | 9/2007 | Yagi et al. | |
| 2008/0013992 | A1 | 1/2008 | Fukuhata et al. | |
| 2008/0013993 | A1 | 1/2008 | Obata et al. | |
| 2008/0063442 | A1 | 3/2008 | Yagi et al. | |
| 2008/0069611 | A1 | 3/2008 | Obata et al. | |

FOREIGN PATENT DOCUMENTS

| | | |
|---|---|---|
| JP | 7-140831 | 6/1995 |
| JP | 2005-292548 | 10/2005 |
| JP | 2007-310210 | 11/2007 |
| JP | 2008-96929 | 4/2008 |

OTHER PUBLICATIONS

U.S. Appl. No. 12/686,706, filed Jan. 13, 2010, Yoshihiro Fukuhata.
Journal of the Society of Rubber Industry, Japan, vol. 62, No. 1, 1989, p. 683-694.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A fusing apparatus for fusing a toner image onto a recording medium using heat and pressure includes a fusing roller; an endless pressing belt disposed opposite the fusing roller; and a pressing member for pressing the endless pressing belt onto the fusing roller. A recording medium with a transferred toner image is passed through a fusing nip between the fusing roller and the pressing belt. The fusing roller includes positive and negative crown portions along the axial direction. The pressing member includes convex and concave surface portions along the longitudinal direction. When the pressing member is pressed onto the fusing roller, the positive and negative crown portions of the fusing roller are engaged with the concave and convex surface portions, respectively, of the pressing member. The pressing member exerts a greater pressing force on the fusing roller at a central portion than at an end portion.

13 Claims, 13 Drawing Sheets

FUSING APPARATUS AND IMAGE FORMING APPARATUS

BACKGROUND OF THE INVENTION

1. Field of the Invention

The present invention generally relates to apparatuses for fusing an image onto a recording medium by heating and pressing the recording medium, and image forming apparatuses having such a fusing apparatus.

2. Description of the Related Art

Image forming apparatuses such as copy machines, printers, facsimile machines, and multifunction peripherals (MFP) are often equipped with a fusing unit configured to fuse a toner image that has been transferred on a recording medium onto the recording medium using heat and pressure. In one example, such a fusing unit includes a fusing roller in which a heating unit is installed, where an endless pressing belt is pressed onto the fusing roller using a pressing member.

When such a fusing apparatus is used to fuse a toner image onto the recording medium, such as a sheet of recording paper, the recording sheet with the toner image transferred thereon is passed through an area referred to as "a fusing nip" that is formed between the fusing roller and the pressing belt. The recording sheet is heated and pressed in the fusing nip so that the toner carried on the recording sheet can be heated and melted and thereby fused onto the recording sheet.

One of the problems which may be encountered during such a fusing operation is that the recording sheet may become attached to the surface of the fusing roller due to the adhesion of the molten toner, thereby preventing proper ejection of the recording sheet. Even if the recording sheet does not become attached to the fusing roller, it may become wound around the fusing roller as the sheet is transported, whereby the recording sheet is curled, which adversely affects the process of transporting or eventually stacking the recording sheets.

In order to overcome such problems, Japanese Laid-Open Patent Application No. 7-140831 discloses a fusing apparatus having a separating nail that contacts the fusing roller downstream of the fusing nip in a direction of transport of the recording sheet. The separating nail is configured to separate the recording sheet from the fusing roller so that the recording sheet does not become wound around the fusing roller.

Japanese Laid-Open Patent Application No. 2007-310210 discloses a fusing apparatus in which a separating roller smaller in diameter than the fusing roller contacts the fusing roller downstream of the fusing nip in the recording sheet transport direction. It is discussed in this publication that the recording sheet can be separated from the fusing roller as the recording sheet is transported along the separating roller.

However, installation of such separating units as the separating nail or the separating roller for ensuring proper separation of the recording sheet increases the size and cost of the fusing apparatus.

SUMMARY OF THE INVENTION

The disadvantages of the prior art are overcome by the present invention which, in one aspect, is a fusing apparatus for fusing a transferred toner image onto a recording medium using heat and pressure. The fusing apparatus includes a fusing roller; a heating unit configured to heat the fusing roller; an endless pressing belt disposed opposite the fusing roller; a pressing member configured to contact an internal peripheral surface of the endless pressing belt; and a biasing unit configured to apply a biasing force to the pressing member in order to press the pressing member onto the internal peripheral surface of the pressing belt so that the pressing belt can be pressed onto the fusing roller.

A fusing nip is formed between the fusing roller and the pressing belt when the pressing belt is pressed onto the fusing roller. The recording medium with a toner image transferred thereon is passed through the fusing nip in order to fuse the toner image onto the recording medium using heat applied to the recording medium via the fusing roller. The fusing roller includes a positive crown portion and a negative crown portion that are alternately formed on a surface of the fusing roller along the axial direction. The pressing member includes a convex surface portion and a concave surface portion that are alternately formed on a surface of the pressing member along the longitudinal direction. When the pressing member is pressed onto the fusing roller, the positive crown portion of the fusing roller is engaged with the concave surface portion of the pressing member while the negative crown portion of the fusing roller is engaged with the convex surface portion of the pressing member. The pressing force exerted by the pressing member on the fusing roller is greater at a central portion of the fusing nip than at an end portion thereof.

In another aspect, the invention is an image forming apparatus having such a fusing apparatus.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed.

In the drawings.

DETAILED DESCRIPTION OF THE PREFERRED EMBODIMENTS

Figure 1:
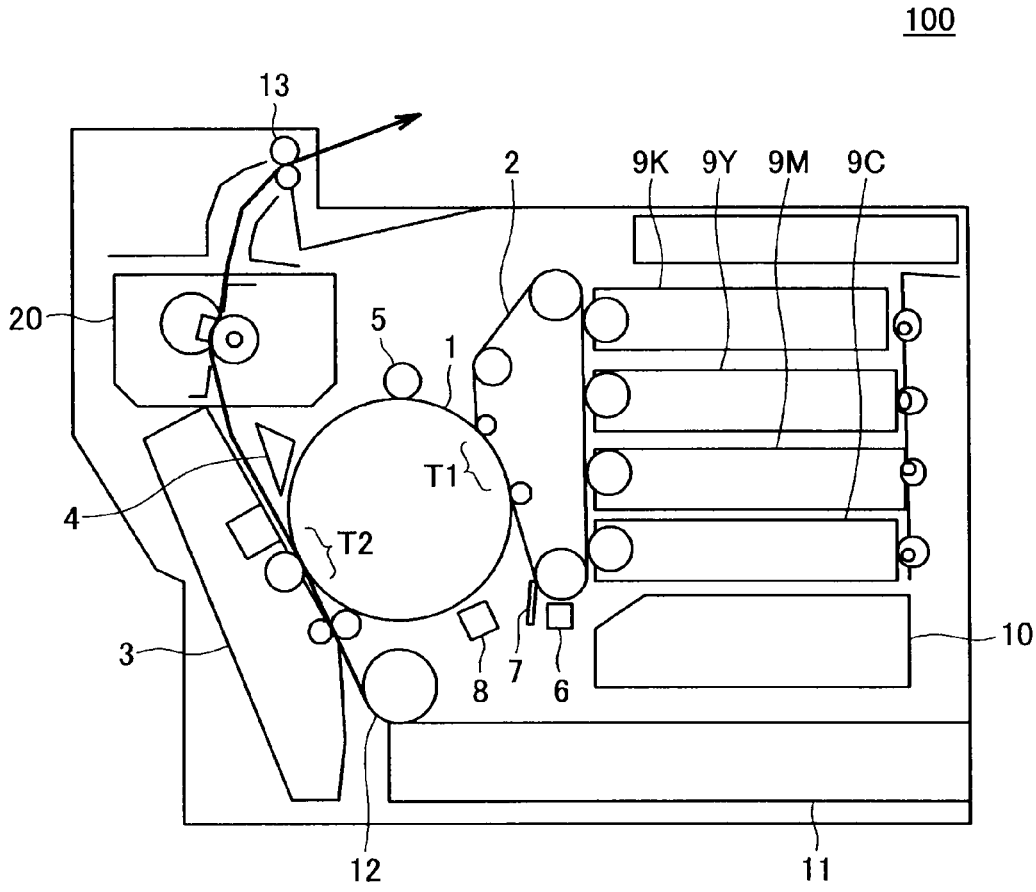
FIG. 1 illustrates an image forming apparatus according to an embodiment of the present invention.

FIG. 1 schematically illustrates a color image forming apparatus 100 according to an embodiment of the present invention. The color image forming apparatus 100 includes an intermediate transfer unit 1 disposed at a central portion within the image forming apparatus 100. Around the intermediate transfer unit 1, there are disposed a photosensitive unit 2, a transfer unit 3, a sheet separating unit 4, and a cleaning unit 5. In the vicinity of the photosensitive unit 2 which may include a photosensitive belt, there are disposed a charging unit 6, a photosensitive body cleaning unit 7, and a residual image removing unit 8.

Further, developing units 9K, 9Y, 9M, and 9C are disposed one above the other, containing corresponding four different colors of toner powder. Below these developing units, there are further disposed an exposing unit 10, a sheet retaining unit 11 for storing recording sheets as a recording medium, and a sheet feeding unit 12. Above the intermediate transfer unit 1 in the color image forming apparatus 100, there are disposed a fusing apparatus 20 and a sheet ejecting unit 13.

After a surface of the photosensitive unit 2 is uniformly charged by the charging unit 6, the surface of the photosensitive unit 2 is exposed to light that is emitted from the exposing unit 10 in accordance with data of an image or characters captured by an image capturing apparatus, such as a personal computer or an image scanner, whereby an electrostatic latent image is formed on the surface of the photosensitive unit 2. Thereafter, the toner is supplied from the developing units 9K, 9Y, 9M, and 9C to the electrostatic latent image in order to develop the electrostatic latent image into a visible color toner image.

The visible toner image on the photosensitive unit 2 is then transported to a first transfer position T1. At the first transfer position T1, the toner image is transferred to a surface of the intermediate transfer unit 1 using a potential difference between the photosensitive unit 2 and the intermediate transfer unit 1 which are powered by a power supply (not shown). After passing through the first transfer position T1, the surface of the photosensitive unit 2 is irradiated with light from the residual image removing unit 8, in order to reduce the surface potential below a predetermined level and thereby erase the electrostatic latent image.

The toner that may remain on the surface of the photosensitive unit 2 after the transfer process at the first transfer position T1 is removed by the photosensitive body cleaning unit 7, thus preparing the photosensitive unit 2 for the next round of toner image formation.

The above steps are performed for the developing units 9K through 9C so that a color toner image corresponding to the desired image or character data can be formed on the surface of the intermediate transfer unit 1. Thereafter, the color toner image is transferred by the transfer unit 3 at a second transfer position T2 onto the recording sheet that is fed from the sheet retaining unit 11 by the sheet feeding unit 12. The recording sheet with the toner image transferred thereon is then separated from the intermediate transfer unit 1 by the sheet separating unit 4 and transported to the fusing apparatus 20. In the fusing apparatus 20, the toner image is fused onto the recording sheet, and the recording sheet with the fused toner image is ejected by the sheet ejecting unit 13.

While the above description is directed to an operation for forming a full-color image on the recording sheet, the principle of the process is equally applicable to the formation of a single-, two-, or three-color toner image by using any one or more of the four developing units 9K, 9Y, 9M, and 9C.

The fusing apparatus 20 according to various embodiments of the present invention is described with reference to FIGS. 2 through 9, wherein like reference numerals designate identical or corresponding parts throughout the several views.

Embodiment 1

Figure 2:
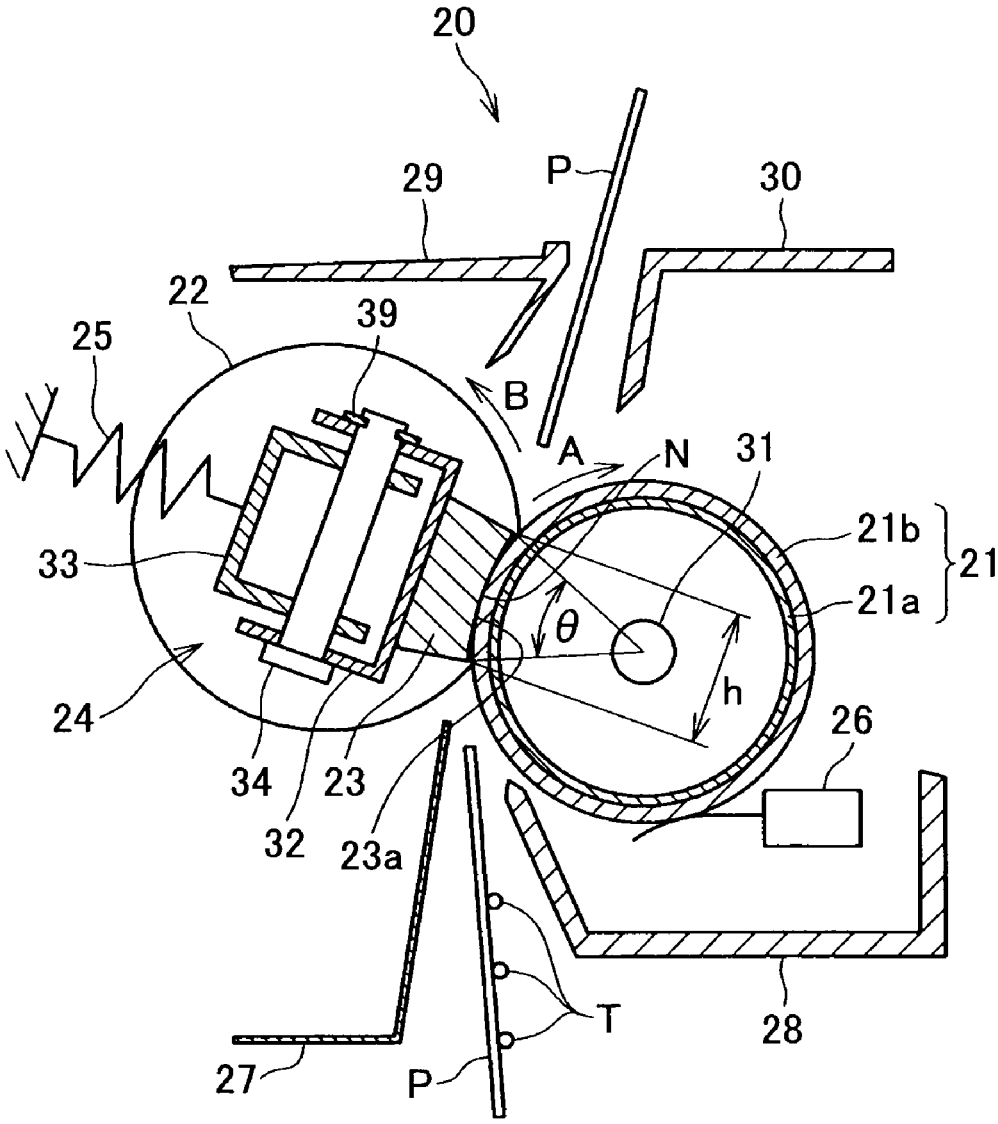
FIG. 2 is a cross section of a fusing apparatus according to an embodiment of the present invention.

FIG. 2 is a schematic cross section of the fusing apparatus 20 according to a first embodiment of the present invention. The fusing apparatus 20 includes a fusing roller 21 in which a heater 31 is installed; an endless pressing belt 22; a pressing member 23 configured to press the pressing belt 22 onto the fusing roller 21; a support member 24 supporting the pressing member 23; a spring 25 which is a biasing unit configured to bias the support member 24; a contacting-type thermistor 26 which is a temperature detecting unit configured to detect a surface temperature of the fusing roller 21; a pair of entry guides 27 and 28; and a pair of exit guides 29 and 30.

The fusing roller 21 is a resilient roller that includes a core 21*a* which may be made of a steel pipe with a thickness of 0.5 mm. The core 21*a* is covered with a silicone rubber layer 21*b* having a JIS hardness of 20 degrees and a thickness of 0.8 mm. The fusing roller 21 may have an external diameter of 26.6 mm. The surface of the fusing roller 21 may be coated with PFA (tetra fluoro ethylene-perfluoro alkylvinyl ether copolymer) to a thickness of 30 μm for ensuring a proper toner releasing property.

The pressing member 23 may be made of silicone rubber having a JIS hardness of 30 degrees and a thickness (i.e., a maximum thickness of a central portion in the longitudinal direction) of 4 mm. Because the silicone rubber of the pressing member 23 is thicker than the silicone rubber layer (0.8 mm) of the fusing roller 21, the pressing member 23 is more easily compressively deformable. Preferably, the pressing member 23 may be made of a resilient material softer than the silicone rubber layer 21*b* of which the surface of the fusing roller 21 is made.

The biasing force provided by the spring 25 is applied via the support member 24 to the pressing member 23. In response, the pressing member 23 presses the internal surface of the pressing belt 22, thereby pressing the pressing belt 22 onto the fusing roller 21. The pressing member 23 has a pressed surface 23*a* opposite the fusing roller 21. The pressed surface 23*a* is formed in a concave shape conforming to the peripheral outer surface of the fusing roller 21. Thus, the pressing belt 22 contacts the fusing roller 21 with a winding angle θ, forming a fusing nip N with a width h where the pressing belt 22 and the fusing roller 21 are in press-contact with each other.

Thus, in accordance with the present embodiment, a sufficient width of the fusing nip N can be ensured even when the fusing roller 21 has a small diameter, compared to a flat shape of the pressed surface of the pressing belt 22. As a result, the size of the fusing apparatus can be reduced and an increased fusing speed can be achieved. In accordance with the present embodiment, toner can be fused at a fusing rate of 200 mm/s when the width h of the fusing nip N is 11 mm and the winding angle θ is 47 degrees.

The fusing roller 21 is driven by a drive source (not shown) to rotate in a direction A. The rotation of the fusing roller 21 causes the pressing belt 22 to be rotated in a direction B. The pressing belt 22 may be made of polyimide and may have a thickness of 80 μm and an internal diameter of 30 mm. The external peripheral surface of the pressing belt 22 may be coated with PFA to a thickness of 30 μm for ensuring a proper toner releasing property.

With reference to FIG. 2, a fusing operation in accordance with the present embodiment is described. First, the heater 31 is activated while the amount of heat generated by the heater 31 is controlled by a control unit (not shown) based on the temperature detected by the thermistor 26, so that a predetermined surface temperature of the fusing roller 21 can be maintained. Then, a recording sheet P with a toner image T formed thereon is entered between the fusing roller 21 rotating in direction A and the pressing belt 22 rotating in direction B. At the fusing nip N, the recording sheet P is heated and pressed in order to fuse the toner image T onto the recording sheet P.

In the following, the fusing roller 21, the pressing member 23, and the support member 24 are described in greater detail. In the following description, the "center" and "ends" of the fusing roller 21, the pressing member 23, and the support member 24 in their axial or longitudinal directions are described as corresponding to the center and ends of the fusing nip N in its longitudinal direction. However, in other embodiments, these locations may not correspond with one another within the scope of the present invention.

Figure 3:
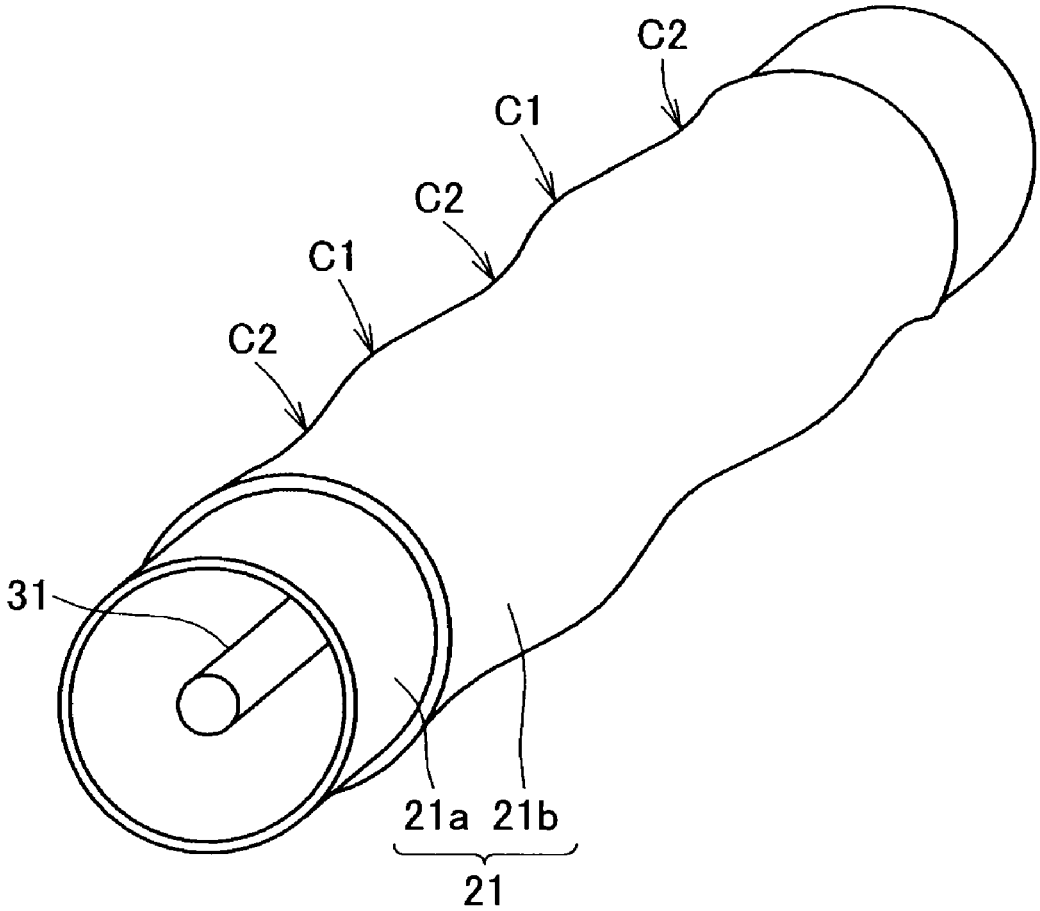
FIG. 3 is a perspective view of a fusing roller of the fusing apparatus of FIG. 2.

FIG. 3 is a perspective view of the fusing roller 21. As illustrated, the silicone rubber layer 21*b* of the fusing roller 21 has varying thicknesses along the axis such that the outer peripheral surface of the fusing roller 21 rises and falls in an undulating fashion. Specifically, the fusing roller 21 has positive crown portions C1 where the outer peripheral surface is formed in a convex manner, and negative crown portions C2 where the outer peripheral surface is concave. The positive and negative crown portions are alternately provided along the axis. In other words, a positive crown is where the diameter of the roller decreases toward either end of the fusing roller 21, while a negative crown is where the diameter of the roller increases toward either end of the fusing roller 21.

Figure 4:
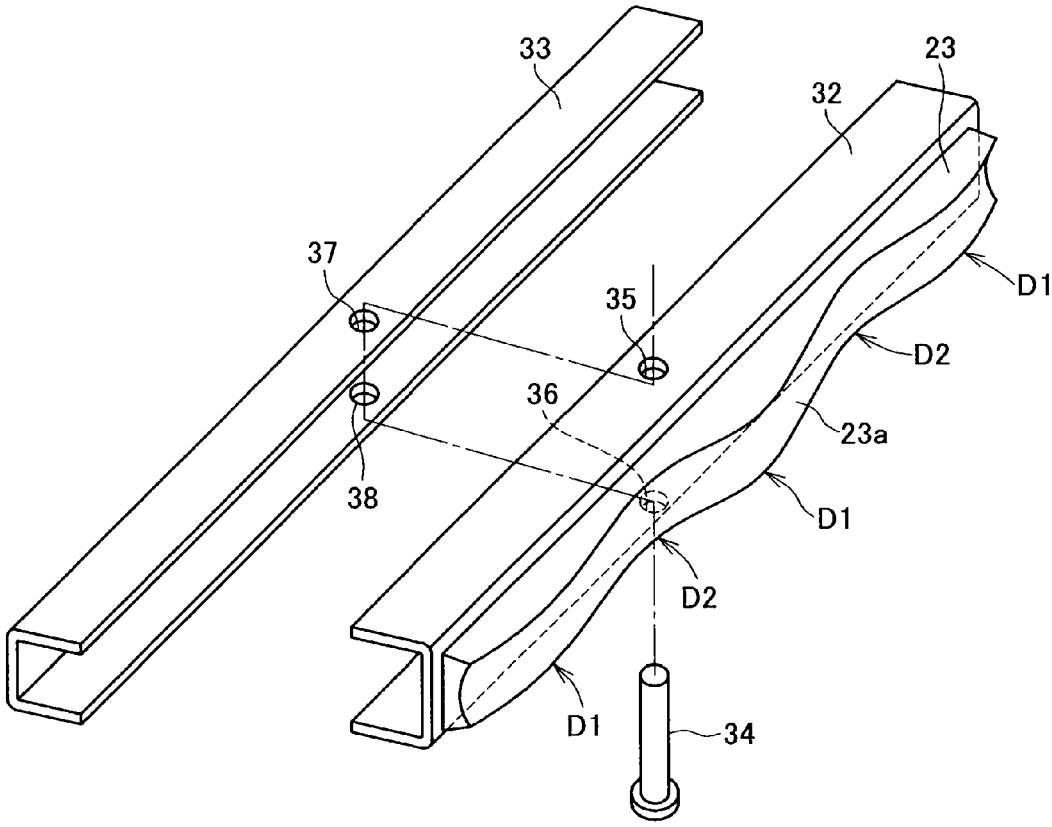
FIG. 4 is an exploded perspective view of a pressing member and a support member of the fusing apparatus of FIG. 2.

FIG. 4 is an exploded perspective view of the pressing member 23 and the support member 24. As illustrated in FIG. 4, the support member 24 includes a first support member 32 for supporting the pressing member 23 in a fixed manner; a second support member 33 for supporting the first support member 32; and a pin 34 for linking the first support member 32 and the second support member 33. The first support member 32 and the second support member 33 are both U-shaped in cross section perpendicular to the longitudinal direction. The support members 32 and 33 have insertion holes 35 through 38 through which the pin 34 is inserted, the insertion holes being provided at a central portion of the respective support members in the longitudinal direction.

In the present embodiment, the size of the U of the first support member 32 is larger than that of the second support member 33, so that the second support member 33 can be partially contained within the first support member 32. When linking the first support member 32 and the second support member 33 using the pin 34, the second support member 33 may be placed in the first support member 32 with their respective openings facing each other, and then the pin 34 is inserted through the insertion holes 35 through 39. One end of the pin 34 is fitted with a stopper 39 (see FIG. 2) for preventing the pin 34 from being detached from the insertion holes 35 through 38. By thus linking the first support member 32 and the second support member 33 using the pin 34, the first support member 32 can be rotated or swung about the pin 34 relative to the second support member 33.

The pressed surface 23*a* of the pressing member 23 is formed in an undulating fashion along the longitudinal direction. Namely, the pressing member 23 has convex surface portions D1 and concave surface portions D2 which are provided alternately in the longitudinal direction.

Figure 5A:
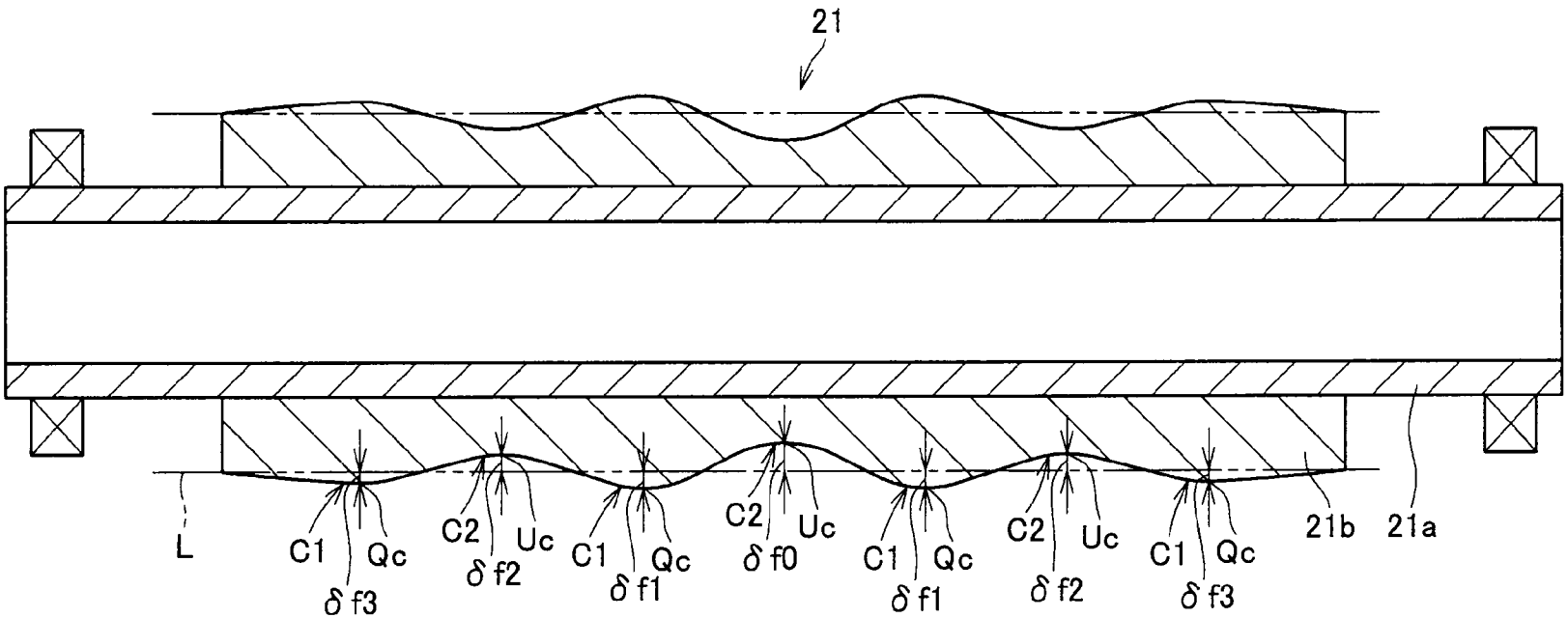
FIG. 5A is a cross section of the fusing roller of FIG. 2.
Figure 5B:
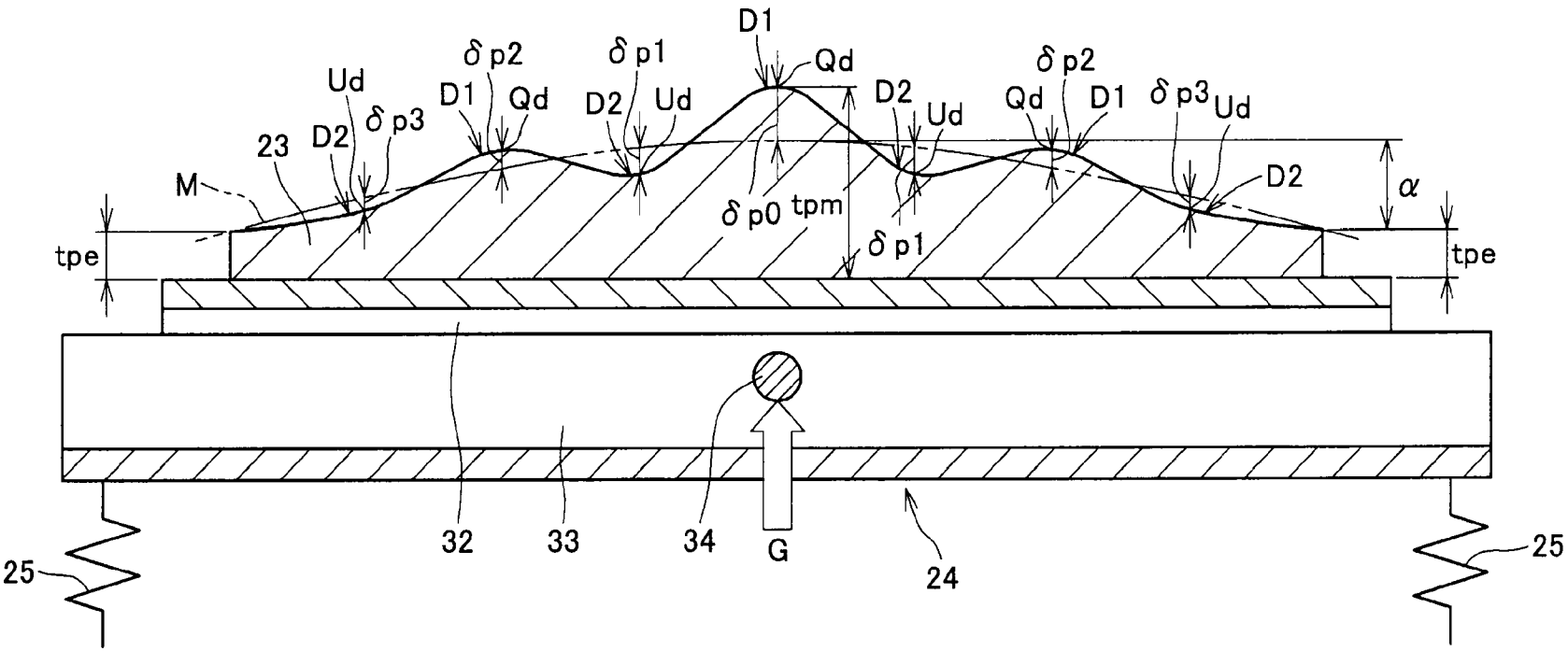
FIG. 5B is a cross section of the pressing member and the support member of FIG. 4.

FIG. 5A is a cross section of the fusing roller 21, while FIG. 5B is a cross section of the pressing member 23 and the support member 24. When the fusing roller 21 and the pressing member 23 are separated from each other as illustrated in FIGS. 5A and 5B, naturally no pressing force is exerted by the pressing member 23 against the fusing roller 21.

With reference to FIG. 5A, Qc indicates the top of each positive crown portion C1. Uc indicates the bottom of each negative crown portion C2. An imaginary line L (indicated by a double-dashed line in FIG. 5A) passing through intermediate positions of the tops Qc and the bottoms Uc in the diameter direction (thickness direction) is referred to as a "reference line". The reference line L is a straight line substantially parallel to the axis (not shown) of the fusing roller 21. The "straight line substantially parallel to the axis" refers to a cylindricity of 0.1 mm or less, taking into account the polishing accuracy of the silicone rubber layer. The term "cylindricity" is intended to refer to a cylindricity with respect to the reference line L of the fusing roller 21, which may be measured as follows.

First, the fusing roller 21 is equally divided (such as into 3 to 16 parts) circumferentially, and then the rising and falling contour (i.e., the positive and negative crown portions) of each part in the axial direction is measured using a displacement meter, such as a laser displacement gauge or a stylus-type profile meter. Based on the measured profile, intermediate positions between the top of each concave portion (positive crown portion) and the bottom of each convex portion (negative crown portion) with respect to the diameter direction are identified, and a line connecting the intermediate positions in the axial direction is taken as the reference line profile in the axial direction at a given point in the circumferential direction.

A shape obtained by measuring such axial reference line profiles of the divided parts (3 to 16 parts) of the fusing roller 21 in the circumferential direction is defined as the cylinder shape of the reference line L of the fusing roller 21. Thus, that the cylindricity is 0.1 mm or less means that the cylinder shape of the reference line L of the fusing roller 21 lies between two coaxial cylinders separated from each other by a radial distance of 0.1 mm.

Referring to FIG. 5A, $\delta f0$ through $\delta f3$ designate the amounts of protrusion (height) of the tops Qc of the positive crown portions C1 and the amounts of recess (depth) of the bottoms Uc of the negative crown portions C2 with respect to the reference line L, where $\delta f0>\delta f1>\delta f2>\delta f3$. Namely, the amounts of protrusion and recess are adjusted such that they decrease from the axial central portion toward either end of the fusing roller 21 in the axial direction. In the present embodiment, because the fusing roller 21 is axially symmetric with respect to its central portion, the amounts of protrusion and recess of the tops Qc and the bottoms Uc at symmetrically corresponding positions are designated with the corresponding reference signs.

With reference to FIG. 5B, Qd indicates the top of each positive crown portion D1, and Ud indicates the bottom of each negative crown portion D2. An imaginary line (double-dashed line) passing through intermediate positions between the top Qd of each convex surface portion D1 and the bottom Ud of each concave surface portion D2 in the thickness direction is referred to as a reference line M. The reference line M is arched, the central portion in the longitudinal direction being closest to the fusing roller 21. Thus, the thickness tpm of the central portion of the pressing member 23 in the longitudinal direction is greater than the thickness tpe at either end of the pressing member 23 in the longitudinal direction. In the illustrated example, the top Qd of the convex surface portion D1 is provided where the thickness of the pressing member 23 in the longitudinal direction is the greatest at the central portion. The "thickness direction" of the pressing member 23 is intended to refer to a direction perpendicular to the plane of transport of the recording sheet.

In FIG. 5B, δp0 through δp3 designate the amount of protrusion of the top Qd of each convex surface portion D1 and the amount of recess of the bottom Ud of each concave surface portion D2 with respect to the reference line M, where δp0>δp1>δp2>δp3. Namely, the amounts of protrusion and recess decrease from the central portion toward either end of the pressing member 23 in the longitudinal direction. In the present embodiment, because the pressing member 23 is axially symmetric with respect to the central portion, the amounts of protrusion and recess of the tops Qd and the bottoms Ud at symmetrical positions are designated by the same signs. In the embodiment illustrated in FIG. 5B, only one convex surface portion D1 which protrudes the most is provided at the central portion of the pressing member 23; in other embodiments, two or more convex surface portions D1 that protrude the most (and by the same amounts) may be provided at the central portion or its vicinity of the pressing member 23.

When the fusing roller 21 is pressed by the pressing member 23, the positive crown portions C1 of the fusing roller 21 are aligned with the concave surface portions D2 of the pressing member 23, while the negative crown portions C2 of the fusing roller 21 are aligned with the convex surface portions D1 of the pressing member 23. Namely, the protrusions and recesses of the pressing member 23 are aligned with the corresponding recesses and protrusions of the fusing roller 21.

With reference to FIGS. 5A and 5B, the amounts of protrusion and recess δp0 through δp3 of the pressing member 23 are related to the amounts of protrusion and recess δf0 through δf3 of the fusing roller 21 such that δp0>δf0, δp1>δf1, δp2>δf2, and δp3>δf3. Namely, the amounts of protrusion and recess of the convex surface portions D1 or the concave surface portions D2 of the pressing member 23 are greater than the amounts of protrusion and recess of the corresponding positive crown portions C1 and the negative crown portions C2 of the fusing roller 21.

As illustrated in FIG. 5B, a spring 25 is provided at each end of the second support member 33. The springs 25 apply a biasing force to the second support member 33 at corresponding ends. Thus, the first support member 32 receives a force G from the second support member 33 via the pin 34 disposed at the axial central portion.

Embodiment 2

Figure 6:
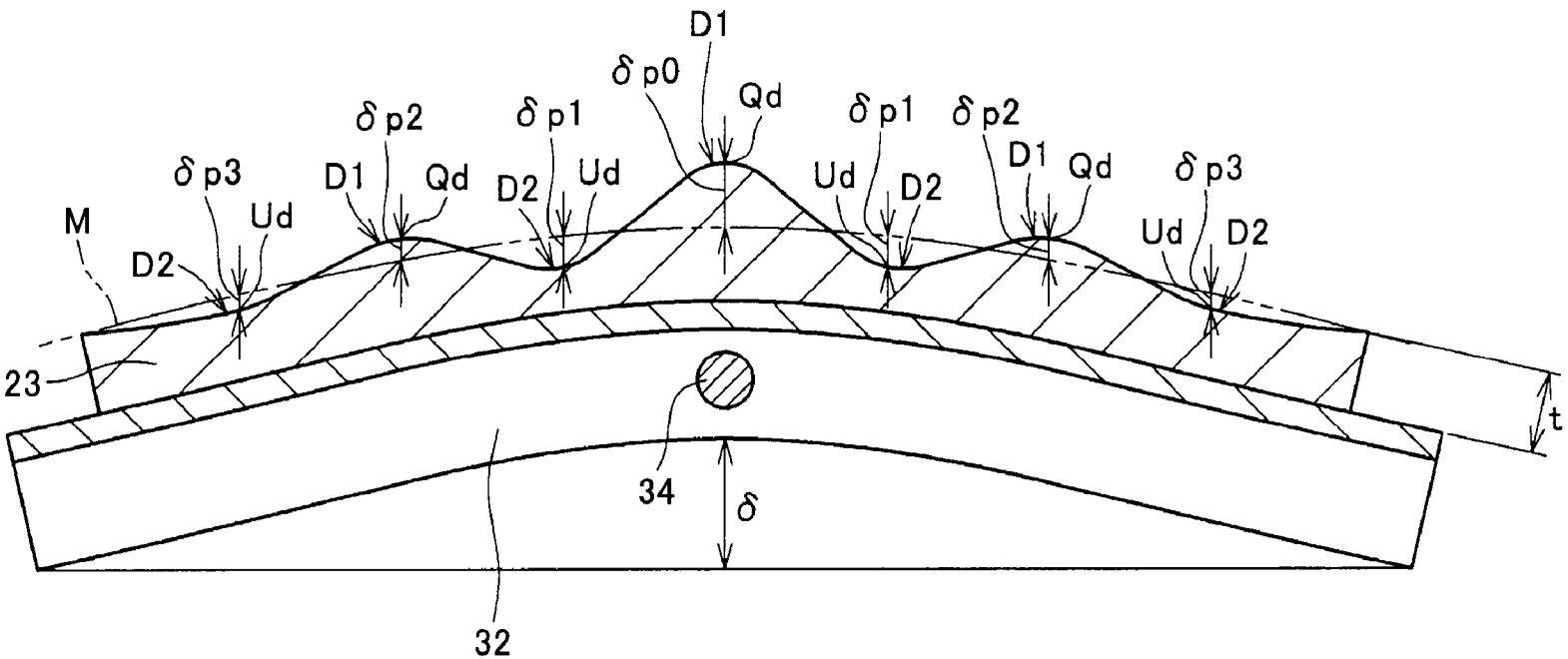
FIG. 6 is a cross section of a pressing member and a support member according to a second embodiment of the present invention.

FIG. 6 illustrates a main part of the fusing apparatus according to a second embodiment of the present invention. As in the foregoing embodiment, the reference line M that passes through the intermediate positions between the top Qd of the convex surface portions D1 and the bottom Ud of the concave surface portions D2 of the pressing member 23 in the thickness direction is curved, with the central portion protruding the most.

However, the second embodiment differs from the first embodiment in that the first support member 32 is not straight but bent so that the bottom of the central portion is extended upward by a distance δ, as illustrated in FIG. 6. The thickness of the reference line M (i.e., the distance t between the reference line M and the first support member 32) may be uniform along the longitudinal direction. The amounts δp0 through δp3 of protrusion and recess of the convex surface portions D1 and the concave surface portions D2 of the pressing member 23 are set to decrease from the central portion toward both ends of the pressing member 23 in the longitudinal direction, as in the first embodiment (δp0>δp1>δp2>δp3).

Embodiment 3

Figure 7:
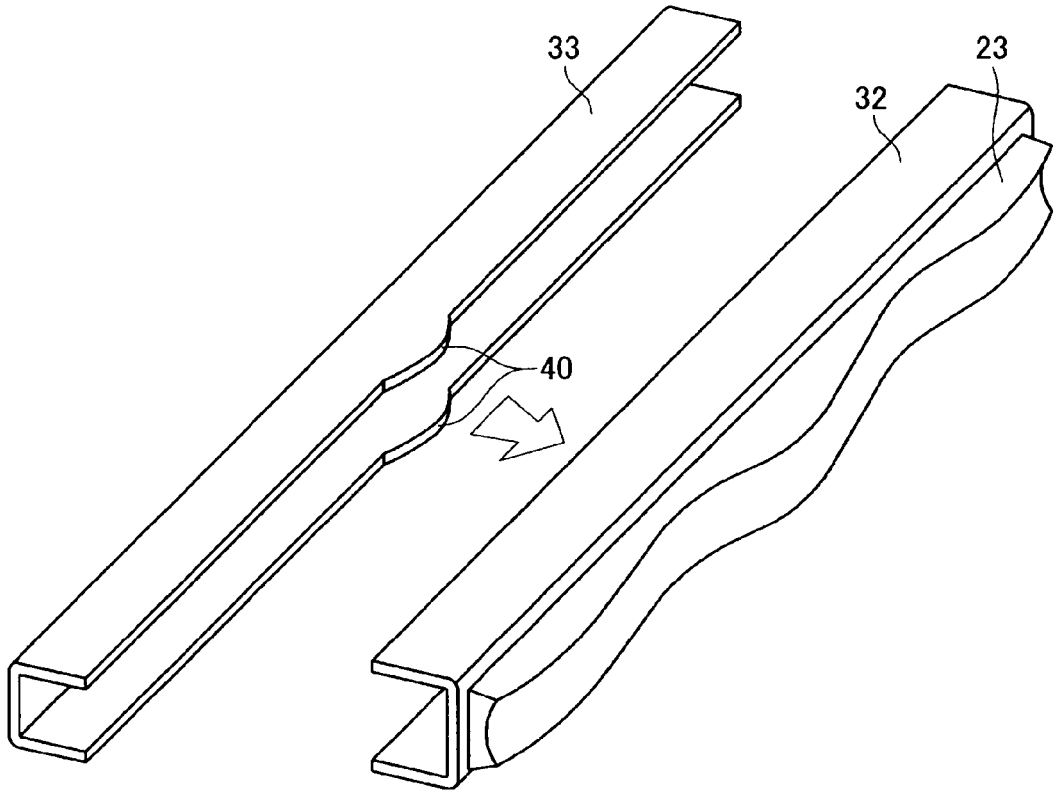
FIG. 7 is an exploded perspective view of a pressing member and a support member according to a third embodiment of the present invention.

FIG. 7 illustrates a main part of the fusing apparatus according to a third embodiment of the present invention. The third embodiment differs from the first embodiment in the supporting structure of the first support member 32 and the second support member 33. Specifically, as illustrated in FIG. 7, an arched protruding portion 40 is formed at the longitudinal central portion of the second support member 33, the protruding portion 40 extending toward the first support member 32. During assembly, the second support member 33 is placed in the first support member 32 with the protruding portion 40 facing the first support member 32. The second support member 33 may be thereafter biased toward the first support member 32 by a biasing unit (not shown), thus butting the protruding portion 40 against the longitudinal central portion of the first support member 32. As a result, the first support member 32 receives a force from the protruding portion 40 at the central portion. After assembly, the first support member 32 can be rotated or swung about its point of contact with the protruding portion 40.

Thus, in accordance with the third embodiment, the first support member 32 can be rotated or swung on the protruding portion 40 of the second support member 33 while being pressed by the second support member 33. Because the third embodiment eliminates the need for the pin 34 of the first embodiment, the number of components can be reduced and cost reduction can be achieved.

Embodiment 4

Figure 8:
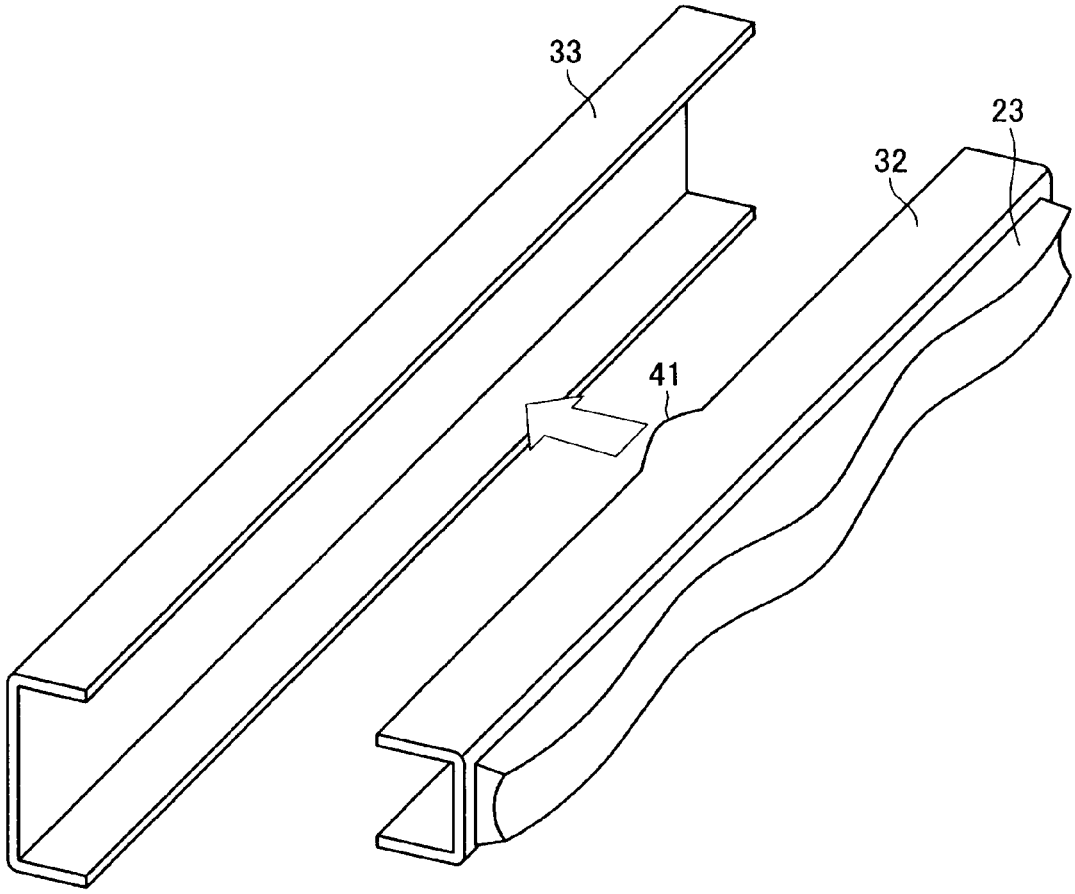
FIG. 8 is an exploded perspective view of a pressing member and a support member according to a fourth embodiment of the present invention.

FIG. 8 illustrates a main part of the fusing apparatus according to a fourth embodiment. In the fourth embodiment, an arched or curved protruding portion 41 is provided at the longitudinal central portion of the first support member 32 instead of the second support member 33, the protruding portion 41 protruding toward the second support member 33. Further, the second support member 33 has a U-shaped cross section that is larger than the U-shaped cross section of the first support member 32, so that the first support member 32 can be partly accommodated within the second support member 33.

After the first support member 32 is accommodated within the second support member 33, the second support member 33 may be biased toward the first support member 32 by a biasing unit (not shown), thus butting the protruding portion 41 against the second support member 33. Thus, a force is applied to the first support member 32 at the protruding portion 41, while the first support member 32 can be rotated or swung about on the protruding portion 41.

The structure of the fusing apparatus according to Embodiments 2 through 4 is similar to that of Embodiment 1 in other respects. Preferably, at least one of the first support member 32 and the second support member 33 may be formed in U-shape in cross section. In this way, the first support member 32 and/or the second support member 33 can be easily manufactured while achieving size and weight reduction and simultaneously ensuring required strength for the pressing force to which the first support member 32 or the second support member 33 is subject. The support members 32 and 33 may be formed in other shapes in cross section perpendicular to the longitudinal direction, such as a square, T, I, or M shape, or a hollow circular shape. Preferably, the first support member 32 illustrated in FIG. 6 may be applied to the embodiment of FIG. 7 or 8.

In the following, the effects of the embodiments of the present invention are described. As described above, in the fusing apparatus of the various embodiments of the invention, the pressing member 23 and the fusing roller 21 are disposed such that their concave and convex portions are aligned in an intermeshed manner when the pressing belt 22 is pressed against the fusing roller 21. The pressing belt 22 is curved where the pressing member 23 and the fusing roller 21 are engaged, so that the fusing nip N is also curved in an undulating manner.

Thus, as a recording sheet is passed through the fusing nip N during the image fusing process, the recording sheet is curved in an undulating manner. Such curving of the recording sheet at the fusing nip N increases the apparent rigidity of the recording sheet as it is transported out of the fusing nip N. The apparent increase in the rigidity of the recording sheet prevents the attachment of the sheet to the fusing roller 21, thus enabling better separation of the recording sheet from the fusing roller 21. However, such curving of the recording sheet during transport may cause the development of wrinkles in the recording sheet.

Figure 9:
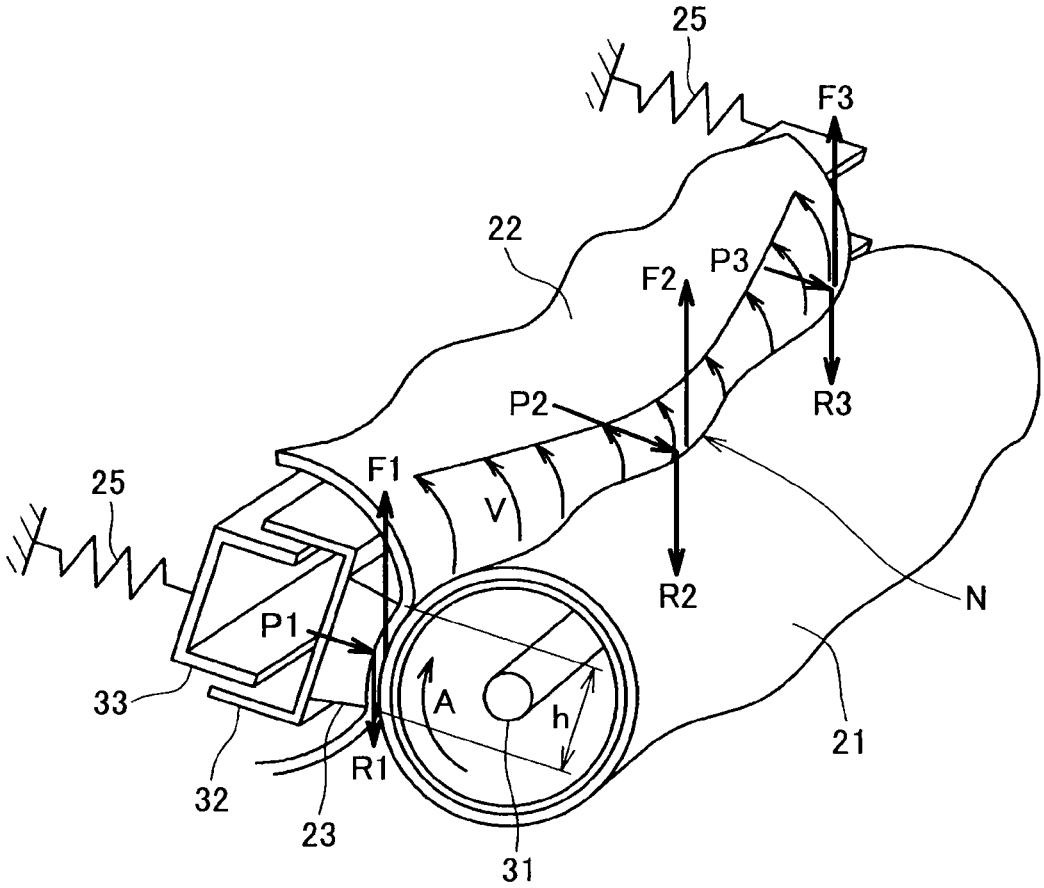
FIG. 9 illustrates an operation of the fusing apparatus according to an embodiment of the present invention.

Next, the relationship between pressure distribution on the pressing member 23 and the fusing roller 21 and the development of sheet wrinkles is discussed with reference to FIG. 9. In FIG. 9, arrows P1, P2, and P3 designate pressing forces of the pressing member 23 that are applied to the fusing roller 21. Arrows F1, F2, and F3 designate transporting forces caused along the axis of the fusing roller 21 at the fusing nip N by the rotation of the fusing roller 21 at a rotating speed A. Arrows R1, R2, and R3 designate frictional load resistance forces produced on the internal surface of the pressing belt 22 by the pressing forces P1, P2, and P3 of the pressing member 23. Arrows V indicate a speed distribution along the width of the pressing belt 22. The numbers in the above designations of the arrows indicate various positions in the axial direction or the longitudinal direction; namely, numbers 1 and 3 designate ends, and number 2 indicates the central portion.

It is generally known that, when a recording sheet is transported by pressing a rotating rubber roller onto the recording sheet, the transport speed of the recording sheet increases as the amount of resilient deformation of the rubber roller, i.e., the pressing force, increases (see, e.g., Journal of the Society of Rubber Industry, Japan, Vo. 62, No. 1 (1989), pp. 683-694). Therefore, when the width h of the fusing nip N is formed by elastic deformation of the surface of the fusing roller 21, the pressing belt 22 is transported at a speed depending on the amount of elastic deformation of the fusing roller 21.

However, in the various embodiments of the present invention, the width h of the fusing nip N is formed by the pressing member 23 whose surface is curved to closely conform to the outer peripheral surface of the fusing roller 21. In addition, the pressing member 23 is soft and its elastic deformation when pressed by the fusing roller 21 is greater than the elastic deformation of the fusing roller 21. Therefore, the transport speed A of the pressing belt 22 that is transmitted from the fusing roller 21 is not much influenced by the elastic deformation of the fusing roller 21. Rather, the transport speed of the pressing belt 22 substantially corresponds to the peripheral speed of the fusing roller 21, which corresponds to the radius of the fusing roller 21.

On the pressing belt 22, the transporting forces F1 through F3 act due to the rotating speed A of the fusing roller 21 as it contacts the pressing belt 22. In addition, the frictional load resistance forces R1 through R3 act on the internal peripheral surface of the pressing belt 22 in contact with the pressing member 23 due to the pressing forces P1 through P3 of the pressing member 23. As a result, the transport speed V of the pressing belt 22 is influenced by the frictional load resistance forces R1 through R3 as well as by the rotating speed A transmitted from the fusing roller 21 as mentioned above. Namely, the transport speed V of the pressing belt 22 is reduced by the frictional load resistance forces R1 through R3 of the pressing member 23. The frictional load resistance forces R1 through R3 increase in proportion to the pressing forces P1 through P3 of the pressing member 23 when the coefficient of friction between the pressing member 23 and the internal peripheral surface of the pressing belt 22 is constant.

In accordance with the various embodiments of the present invention, the reference line M of the pressing member 23 is the most protruded at the longitudinal central portion, while the reference line L of the fusing roller 21 is formed as a straight line (see FIGS. 5A and 5B). Therefore, the central portion of the pressing member 23 exerts the pressing force P2 which is greater than the pressing forces P1 and P3 exerted at the corresponding ends. In other words, the pressing force exerted by the pressing member 23 onto the fusing roller 21 is greater at the center of the fusing nip N than at its ends. As a result, the frictional load resistance force R2 at the central portion is greater than the frictional load resistance forces R1 and R3 at the ends, and therefore the speed V2 of the pressing belt 22 at the central portion is lower than the speed V1 or V3 at the ends. Namely, the speeds V1 and V3 at the ends are greater than the speed V2 at the central portion. Thus, because the transport speed distribution of the recording sheet corresponds to the transport speed distribution V of the pressing belt 22, the development of wrinkles in the recording sheet as it is transported can be prevented.

Next, a method of setting the amount of protrusion $\alpha$ of the reference line M of the pressing member 23 of FIG. 5B is described. The fusing roller 21 of FIG. 9 may be supported at its longitudinal ends on a frame of the image forming apparatus using a bearing mechanism and the like, which is not illustrated. The fusing roller 21 is thus negatively curved at its central portion when the pressing member 23 is pressed against the fusing roller 21. It should be noted that in FIG. 9 the curvatures are exaggerated for illustrative purposes.

The greater the amount of such curvature of the fusing roller 21, the smaller the pressing force P2 at the central portion becomes, so that the sheet transport speed increases at the central portion and the development of sheet wrinkles becomes more likely. In particular, when the fusing apparatus employs a small-diameter fusing roller for size reduction purposes, the rigidity of the core of the fusing roller may be reduced so much that the development of sheet wrinkles due to the curving of the fusing roller may become significant.

Therefore, in accordance with the various embodiments of the present invention, the pressing member 23 is formed such that it protrudes the most at its central portion. Such a protrusion at the central portion of the pressing member 23 compensates for the warping of the fusing roller 21, thereby increasing the pressing force P2 at the central portion and preventing sheet wrinkles.

More specifically, sheet wrinkles are prevented by making the sum of the amount of protrusion of the reference line M of the pressing member 23 and the amount of its warping greater than the amount of warping of the fusing roller 21. However, if the amount of protrusion $\alpha$ of the reference line M is excessive, the pressing force of the pressing member 23 at the side edges of the recording sheet may become insufficient for fusing the toner at the edges.

Thus, the sum of the amount of protrusion $\alpha$ of the reference line and the amount of its warping is preferably more than the amount of warping of the fusing roller 21 by about 0.05 mm to about 0.2 mm and more preferably about 0.1 mm. Preferably, the ratio of the pressing force at the central portion to that at either end of the recording sheet is in a range of about 1.2:1.0 to about 4.0:1.0 and more preferably about 2.0:1.0 to about 3.0:1.0.

In an embodiment, the core of the fusing roller 21 may have an outer diameter of 0.25 mm and a thickness of 0.5 mm, and the core may be made of iron. The pressing member 23 may have a pressing force of 392 N and the amount of warping of the fusing roller 21 may be 0.2 mm. In this embodiment, when the amount of warping of the pressing member 23 due to the warping of the first support member 32 is 0.1 mm, the amount of protrusion α of the reference line M of the pressing member 23 is set to be 0.2 mm. As a result, in this embodiment, the sum of the amount of protrusion α of the reference line M and the amount of warping of the pressing member 23 itself is 0.3 mm, whose difference from the amount of warping of the fusing roller 21, or 0.2 mm, is 0.1 mm, which is in an appropriate range.

In Embodiment 1, the first support member 32 is configured to receive the force G from the second support member 33 via the pin 34 provided at the central portion (see FIG. 5B). Therefore, the loading point of the pressing member 23 supported by the first support member 32 is also at the longitudinal central portion of the pressing member 23. Such a central loading structure, in addition to the protrusion of the reference line M of the pressing member 23 at its central portion, helps to make the pressing force P2 of the pressing member 23 at its central portion greater than the pressing forces P1 and P3 at corresponding ends.

Thus, the frictional load resistance force R2 at the central portion becomes greater than the frictional load resistance forces R1 and R3 at corresponding ends. As a result, the speed V2 of the pressing belt 22 at the central portion becomes lower than the speeds V1 and V3 at corresponding ends of the pressing belt 22, thereby preventing the development of wrinkles in the recording sheet during transport.

Further, because the first support member 32 can be rotated or swung about the pin 34, the distribution of the pressing force in the longitudinal direction of the pressing member 23 can be stabilized. Although the fusing roller 21 is supported by a support unit (not shown) and the like of the image forming apparatus main body, such support unit may be bent or twisted due to the movement of the fusing roller 21 or its rotating force. If that happens, the second support member 33, retaining the pressing member 23 such that it is butted against the fusing roller 21, may be tilted horizontally.

In accordance with the present embodiment, however, a constant pressure distribution of the pressing member 23 with respect to the fusing roller 21 in the longitudinal direction is maintained such that the pressure is the largest at the central portion and becomes smaller toward the ends. This is because the loading point of the pressing member 23 is constantly located at the central portion due to the presence of the pin 34 even when the second support member 33 is horizontally tilted. In this way, the longitudinal pressure distribution of the pressing member 23 with respect to the fusing roller 21 can be constantly made such that the pressure is the greatest at the central portion, so that a fusing operation can be performed stably without sheet wrinkles.

In Embodiments 3 and 4, too, as described with reference to FIGS. 7 and 8, the first support member 32 is configured to receive the force at the longitudinal central portion and can also be rotated or swung about the central portion. Thus, a similar pressure distribution of the pressing member 23 can be maintained such that the pressure is the greatest at the central portion and becomes smaller toward the ends.

Preferably, the pressing member 23 is made of a resilient material that is softer than the surface of the fusing roller 21. By so doing, warping of the fusing roller 21 can be almost eliminated when the fusing roller 21 is subject to the pressing force from the pressing member 23. Thus, a constant peripheral speed of the fusing roller 21 can be maintained as it rotates about its longitudinal axial, so that the fusing roller 21 does not affect the transport of the recording sheet. Further, the deformation of the fusing roller 21 when pressed by the pressing member 23 can be reduced, thereby preventing the development of permanent warping of the surface of the fusing roller 21. As a result, variation in the transport speed of the recording sheet due to such permanent warping of the fusing roller 21 can be prevented, which also contributes to the prevention of sheet wrinkles.

Thus, in accordance with the various embodiments of the present invention, the pressing force exerted by the pressing member 23 varies between its central portion and end portions, and a constant width of the fusing nip N is ensured by the concave shape of the pressing surface of the pressing member 23 in conformity with the outer peripheral surface of the fusing roller 21, so that a proper fusing property can be obtained.

As described above, in accordance with the various embodiments of the present invention, the reference line M of the pressing member 23 is formed in a convex shape such that the pressing member 23 is the most protruding at its longitudinal central portion, while the reference line L of the fusing roller 21 is formed in a straight line. Theoretically, the same effect of increasing the pressing force exerted by the central portion of the pressing member 23 relative to its end portions can be obtained by forming the reference line M of the pressing member 23 in a straight line while the reference line L of the fusing roller 21 is formed in a convex shape with the maximum protrusion at its central portion.

However, in accordance with the embodiments of the present invention, the reference line L of the fusing roller 21 is formed in a straight line for the following two reasons. One is related to the question of surface temperature of the fusing roller, and the second is related the issue of transport speed distribution of the recording medium.

First, the issue of surface temperature of the fusing roller is discussed. Supposing that, contrary to the foregoing embodiments of the present invention, the reference line L of the fusing roller 21 is formed in a convex shape so that it protrudes the most at its axial central portion, the thickness of the fusing roller 21 increases at the central portion, and it becomes difficult to maintain a uniform surface temperature along the axis of the fusing roller 21. As a result, problems of image luster irregularities may occur. While such luster irregularities or other problems may also occur when the thickness of the core 21*a* of the fusing roller 21 is increased at its central portion, the problem is more noticeable when the thickness of the silicone rubber layer 21*b* is increased at its central portion.

In order to reduce such luster irregularities and the like, the surface temperature of the fusing roller 21 may be made uniform by increasing the amount of heat produced at the thicker portion of the fusing roller 21 while reducing the amount of heat at its thinner portion. However, in this case, the silicone rubber layer 21*b* of the fusing roller 21 may be degraded by the increased amount of heat (higher temperature).

Further, if the reference line M of the fusing roller 21 is formed in a convex shape so that the thickness of the silicone rubber layer 21*b* is increased at its central portion, heat transfer from the heater 31 may be delayed at the central portion, taking more time for warm-up, for example. On the other hand, because the heat transfer from the fusing roller 21 to the pressing member 23 takes place via the pressing belt 22, the problem of variations in surface temperature can be avoided even if the reference line M of the pressing member 23 is formed in a convex shape as long as the surface temperature of the fusing roller 21 is managed properly.

In the following, the question of transport speed distribution of recording sheets is discussed. Supposing now that, contrary to the various embodiments of the present invention, the reference line L of the fusing roller 21 is formed in a convex shape such that it protrudes the most at its axial central portion, the diameter of the fusing roller 21 is larger at its axial central portion and therefore the transport speed (circumferential speed) of the central portion is higher than that of its end portions. As a result, the speed of the pressing belt 22 becomes higher at its central portion than at the end portions, thereby causing sheet wrinkles. Such a problem of transport speed distribution does not occur when the reference line M of the pressing member 23 has the convex shape because the pressing member 23 does not rotate.

Thus, in accordance with the embodiments of the present invention, the reference line M of the pressing member 23 is formed in a convex shape while the reference line L of the fusing roller 21 is formed in a straight line. In this way, the problems of wrinkles in the recording sheet, luster irregularities, and the increase in heating time can be effectively prevented.

In accordance with the embodiments of the present invention, while the fusing nip N is curved by pressing the pressing member 23 onto the fusing roller 21 with their concave and convex portions engaged with one another in a corresponding manner, it may be difficult to achieve a completely corresponding alignment of the concave and convex portions due to geometric or mounting errors in the fusing roller 21 or the pressing member 23. If a gap is produced in the fusing nip N due to such errors, fusing defects or sheet wrinkles may be caused.

Such potential problems are prevented by increasing the amounts of protrusion and recess δp0 through δp3 of the convex and concave surface portions D1 and D2 of the pressing member 23 relative to the amounts of protrusion and recess δf0 through δf3 of the positive and the negative crown portions C1 and C2 of the fusing roller 21 (see FIGS. 5A and 5B). In this way, any engagement error between the concave and convex portions of the fusing roller 21 and the pressing member 23 due to positional error and the like can be compensated for, thereby eliminating a gap in the fusing nip N and preventing the development of fusing defects or sheet wrinkles.

The aforementioned problem of engagement error may also be avoided by increasing the amounts of protrusion and recess of the positive and negative crown portions C1 and C2 of the fusing roller 21 relative to the amounts of recess and protrusion of the convex and concave surface portions D1 and D2 of the pressing member 23, contrary to the embodiments of the present invention. However, the embodiments of the present invention do not adopt this solution for the following two reasons. One is related to the issue of surface temperature of the fusing roller, and the other is related to the issue of transport speed distribution of recording sheets.

The issue of surface temperature of the fusing roller 21 is discussed. Supposing that, contrary to the embodiments of the present invention, the amounts of protrusion and recess of the fusing roller 21 are increased relative to the amounts of protrusion and recess of the pressing member 23, the thickness of the fusing roller 21 increases, and as a result the time it takes for warm-up, for example, increases. Further, as the surface irregularities increase, it becomes more difficult to maintain a uniform surface temperature of the fusing roller 21 along its axis. As a result, variations in surface temperature of the fusing roller 21 increase, and image luster irregularities may be caused.

Although a uniform surface temperature may be maintained by increasing the amount of heat generated at the thicker portions of the fusing roller 21 than that at the thinner portions, doing so may cause thermal degradation in the silicone rubber layer 21*b* of the fusing roller 21 where increased amounts of heat are applied. Such a problem is avoided when the amounts (lengths and depths) of protrusion and recess of the pressing member 23 are increased because the fusing roller 21 applies heat to the pressing member 23 via the pressing belt 22.

Next, the issue of transport speed distribution of recording sheets is discussed below. Suppose that, contrary to the present invention, the amounts of protrusion and recess of the fusing roller 21 are made more than the amounts of protrusion and recess of the pressing member 23. Then, the circumferential speed differs greatly between the positive crown portions C1 and the negative crown portions C2, and the local transport speed difference of the recording sheets increases. As a result, particularly when the recording sheet is very thin, wrinkles may be caused where there is a large transport speed difference. On the other hand, since the pressing member 23 does not rotate, such a problem of transport speed distribution does not develop when the amounts of protrusion and recess of the pressing member 23 are increased.

Thus, in accordance with an embodiment of the present invention, the amounts of protrusion and recess of the pressing member 23 are made larger than the amounts of protrusion and recess of the fusing roller 21. In this way, the aforementioned engagement error due to position error can be absorbed, so that sheet wrinkles can be effectively prevented and the problems of luster irregularities and the increase in heating time can be prevented.

In accordance with an embodiment of the present invention, the pressing force exerted by the pressing member 23 is increased at its central portion. In this case, if the amounts of protrusion and recess at the central portions of the fusing roller 21 and the pressing member 23 (C1, C2, D1, and D2) are small, the concave and convex portions may be greatly elastically deformed when the fusing roller 21 and the pressing member 23 are pressed to each other, thereby potentially failing to curve the fusing nip N sufficiently. If the fusing nip N cannot be sufficiently curved, the effect of increasing the apparent rigidity of the recording sheet decreases, so that the recording sheet cannot be separated from the fusing roller 21 properly. Thus, in accordance with the embodiment, the amounts of protrusion and recess at the central portions of the fusing roller 21 and the pressing member 23 (C1, C2, D1, and D2) are increased. In this way, the fusing nip N can be sufficiently curved even when a large pressing force is applied to the concave and convex portions, thus ensuring good separation of the recording sheet.

On the other hand, the pressing force is decreased at the ends of the pressing member 23. If the amounts of protrusion and recess at the ends of the fusing roller 21 and the pressing member 23 (C1, C2, D1, and D2) are large, the engagement error between the concave and convex portions may not be absorbed. As a result, formation of a uniform fusing nip may be prevented at the end portions, resulting in the development of a fusing defect or sheet wrinkles. Thus, in accordance with the embodiment, the amounts of protrusion and recess at the end portions of the fusing roller 21 and the pressing member 23 (C1, C2, D1, and D2) are reduced. In this way, sufficient engagement between the concave and convex portions can be obtained even when the pressing force is small, thus ensuring good image formation.

Preferably, the amounts of protrusion and recess of the concave and convex portions (C1, C2, D1, and D2) of the fusing roller 21 and the pressing member 23 in a no-load condition where they are not pressed upon each other are 0.2 mm or more and 1 mm or less. The values of 0.2 mm or more are preferable because if they are less than 0.2 mm, a sufficient amount of curving of the recording sheet may not be obtained at the fusing nip N, thereby failing to provide the necessary apparent rigidity of the recording sheet for its proper separation. The values of 1 mm or less are preferable because if the amounts of protrusion and recess exceed 1 mm, the transport speed difference between a concave portion and a convex portion may become excessive, resulting in the development of recording sheet wrinkles. By setting the values of the amounts of protrusion and recess of the concave and convex portions of the fusing roller 21 and the pressing member 23 within the above range, a sufficient apparent rigidity of the recording sheet can be obtained. Thus, the attaching of the recording sheet onto the fusing roller 21 can be reliably prevented while the recording sheet that leaves the nip can be free of wrinkles, thereby enabling a good image formation process.

In the following, examples of the present invention are described. These examples do not limit the present invention. In the following description, moisture percentage values of are with respect to mass.

Figure 10:
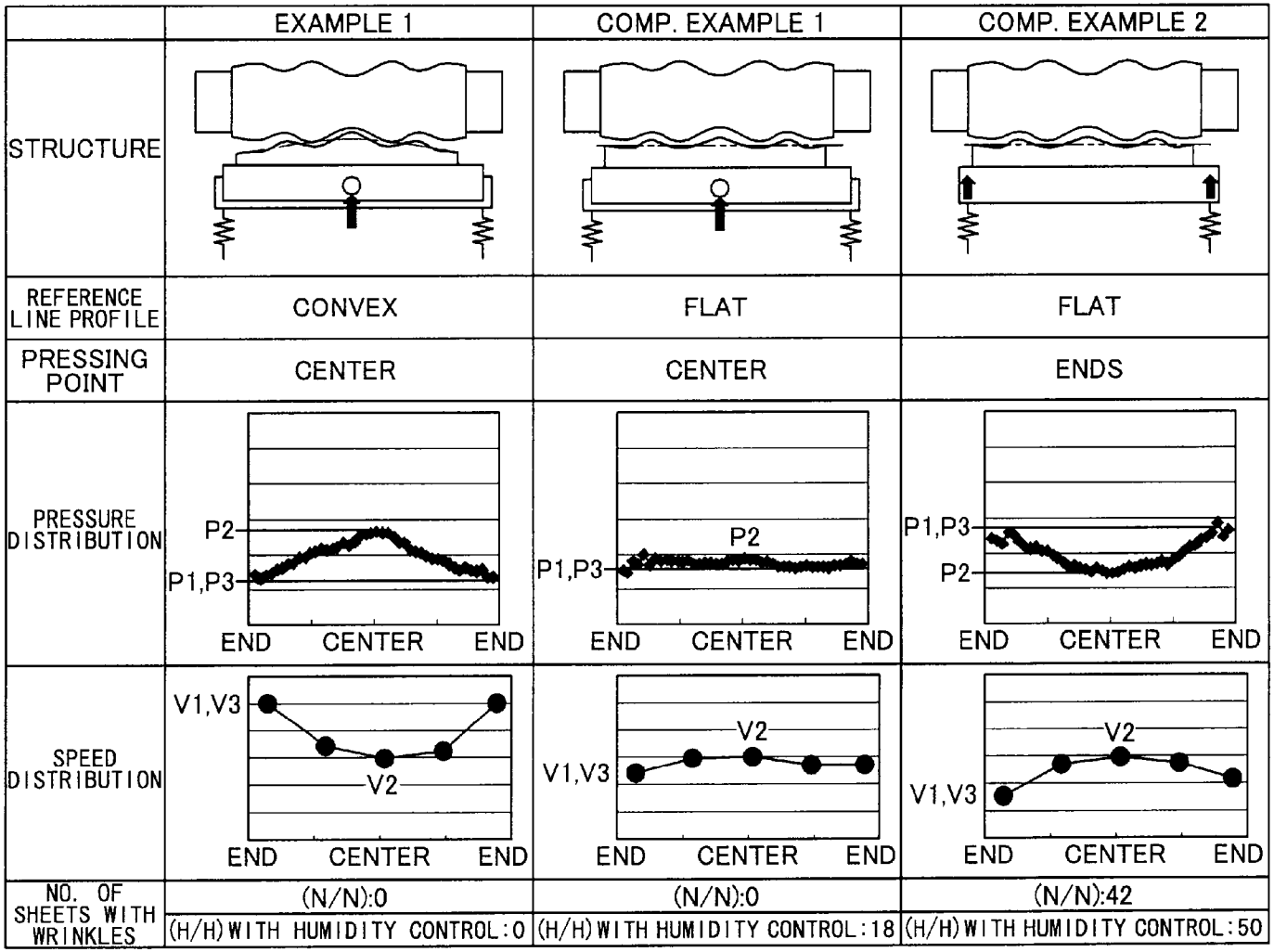
FIG. 10 is a table illustrating the results of evaluation of the effect of preventing sheet wrinkles according to Example 1 of the present invention and Comparative Examples 1 and 2.

FIG. 10 is a table of the results of evaluation of the following three examples of fusing apparatuses in terms of pressure distribution of the pressing force exerted by the pressing member, speed distribution of recording sheet, and sheet wrinkles. In FIG. 10, the double-dashed lines in the "Structure" row of the table indicate the reference line of the pressing member.

EXAMPLE 1

The reference line of the pressing member has a convex shape such that the central portion is the most protruding (the amount of protrusion: 0.2 mm). The loading point is at the center in the longitudinal direction.

COMPARATIVE EXAMPLE 1

The reference line of the pressing member has a flat shape, and the loading point is at the longitudinal center.

COMPARATIVE EXAMPLE 2

The reference line of the pressing member has a flat shape, and the loading points are located at the two end portions of the recording sheet in the longitudinal direction.

The pressure distribution of the pressing force was measured using a pressure distribution measuring system (I-SCAN) available from Nitta Corporation. Specifically, pressure distribution of the pressing member in the longitudinal direction when the pressing member contacts the fusing roller via the pressing belt was measured. The speed distribution of the recording sheet was measured as follows.

First, an A4-sized recording sheet was prepared that had been printed only at a front end portion using a special toner that transfers to the fusing roller. The recording sheet had slits extending 30 mm off the front end to the rear end, disposed at 30 mm intervals along the width of the recording sheet. When the recording sheet was passed through the fusing apparatus, the toner was transferred to the fusing roller and was then transferred to the recording sheet again, whereby a toner image was formed on the recording sheet for each revolution of the fusing roller. The recording sheet speed was determined by measuring the distance of such a toner image.

The development of sheet wrinkles was evaluated under the following conditions.

- Recording sheet: RICOH-6200 (A4 size, vertical grain, basis weight 69 g/m$^2$)
- Print mode: White paper, 50 sheets (four-color mode)
- Environment (N/N): 22° C., 55% RH, (recording sheet immediately after opening of the package)
- Environment (H/H) with humidity control: 28° C., 80% RH (humidity of recording sheet controlled by allowing a stack of 250 sheets to stand for 48 hours)

As will be seen from FIG. 10, in the case of Example 1, as mentioned above, the pressing member had a pressing force distribution such that the pressing force P2 at the center was larger than the pressing forces P1 and P3 at corresponding ends. The central pressing force P2 was about twice the pressing forces P1 and P3 at corresponding ends. The recording sheet speed distribution was such that the speeds V1 and V3 at corresponding ends were higher than the speed V2 at the center. More specifically, the speeds V1 and V3 were higher than the central speed V2 by about 0.2%. No sheet wrinkles were observed in either the environment (N/N) or the environment (H/H) with humidity control.

In Comparative Example 1, because the pressing member has a flat shape, both the pressure distribution and the recording sheet speed distribution are also substantially flat. Thus, while no sheet wrinkles were observed in the environment (N/N) where the recording sheet was used immediately after opening of package, sheet wrinkles were observed in 36% (18/50) of the recording sheets in the environment (H/H) with humidity control. This is due to the following reasons. In the environment (H/H) with humidity control, the recording sheet has a large moisture percentage of 12% to 16%. When heated by the fusing apparatus, the moisture percentage of the recording sheet decreases to about 4%, and as it does so, the recording sheet shrinks, causing an out-of-plane deformation. Thus, when the toner recording sheet speed distribution is flat, the ends of the recording sheet cannot be pulled, thereby failing to sufficiently prevent the development of sheet wrinkles due to shrinkage of the recording sheet.

In Comparative Example 3, the pressing member is flat and the structure is such that the pressing member is pressed at both ends, so that the pressing member itself is curved with the center depressed. As a result, the pressing member has a pressure distribution such that the pressing forces P1 and P3 at the ends are greater than the pressing force P2 at the center. The end pressing forces P1 and P3 were about 2.2 times the central pressing force P2. Thus, contrary to Example 1, the recording sheet speed distribution is such that the end speeds V1 and V3 are lower than the center speed V2 by about 0.1%, as indicated by the corresponding graph where the center is convex. Thus, in the environment (N/N), sheet wrinkles were observed in 42 sheets out of the 50 sheets. In the environment (H/H) with humidity control, sheet wrinkles were observed in all of the 50 sheets.

Thus, in accordance with an embodiment of the present invention, the apparent rigidity of the recording sheet is increased upon leaving the fusing nip, so that the attaching of the recording sheet around the fusing roller can be prevented. As a result, jamming of the recording sheet, for example, can be prevented, thus providing a highly reliable fusing apparatus and image forming apparatus. Furthermore, an embodiment of the present invention can improve the separating property of the recording sheet without requiring a separating nail or a separating roller as often provided in the related art, thus enabling reduction in size and cost of the apparatus. The development of wrinkles in the recording sheet can also be prevented, thus enabling a satisfactory image forming operation.

Tests were also conducted to determine the relationship between the number of curves in the fusing nip and the apparent rigidity of the recording sheet upon leaving the fusing nip, as described in detail below. The fusing apparatuses used for the tests employed a pressing roller instead of a pressing belt.

The fusing apparatuses used included first fusing apparatuses whose fusing roller and pressing roller had positive and negative crown portions, and a second fusing apparatus whose fusing roller and pressing roller did not have any positive or negative crown portions. The first fusing apparatuses included one type that had three each of the positive crown portions and the negative crown portions, and another type that had seven each of the positive crown portions and the negative crown portions. In each of those types, the amplitude (height) of the positive and negative crown portions was 0.2 mm. In all of the fusing apparatuses used for the tests, the resilient layers of the fusing roller and the pressing roller each had a thickness of 1.7 mm. In each fusing apparatus, the apparent rigidity was measured for various recording sheets having the basis weights of 64 g/m$^2$, 69 g/m$^2$, and 90 g/m$^2$.

Figure 11:
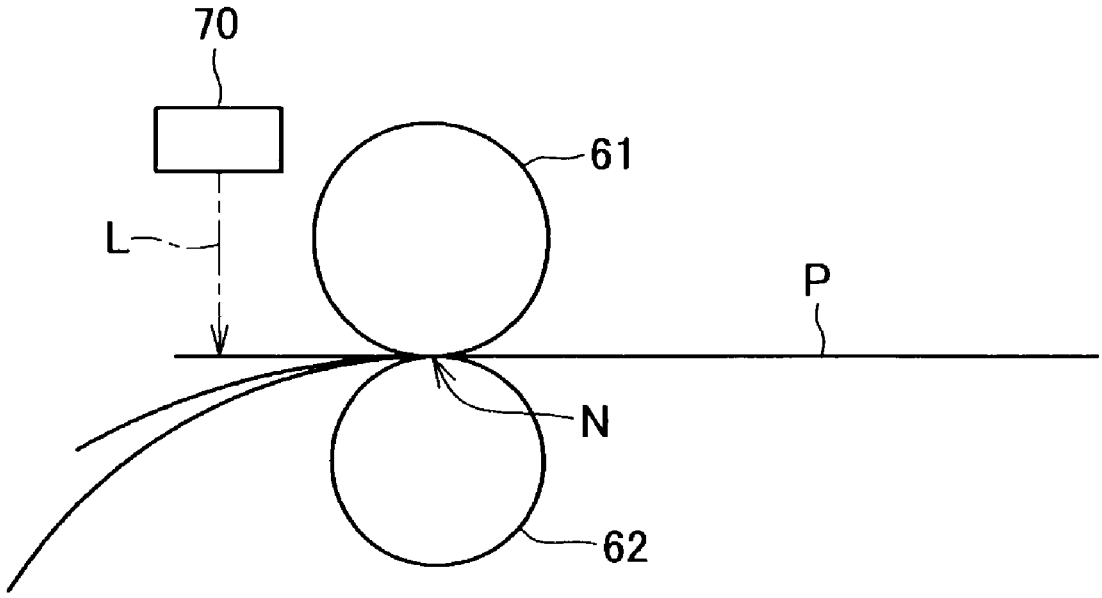
FIG. 11 illustrates a method of measuring the apparent rigidity of a recording sheet.

The method of measuring the apparent rigidity of the various recording sheets is briefly described. First, as illustrated in FIG. 11, a recording sheet P is passed through a fusing nip N formed between the fusing roller 61 and the pressing roller 62. When a front end portion of the recording sheet P is irradiated with a beam of laser light L from a displacement measuring apparatus 70, the transport of the recording sheet P is stopped. After the vibration of the recording sheet P as it comes to a stop is gone, the recording sheet P which is curved is irradiated with the laser light L from the displacement measuring apparatus 70 in order to measure a displacement of the recording sheet P. Thereafter, the recording sheet P is moved by a predetermined distance, and again the recording sheet P is irradiated with the laser light L in order to measure its displacement. Based on the measured displacements of the recording sheet P, an apparent rigidity of the recording sheet P is calculated.

Figure 12:
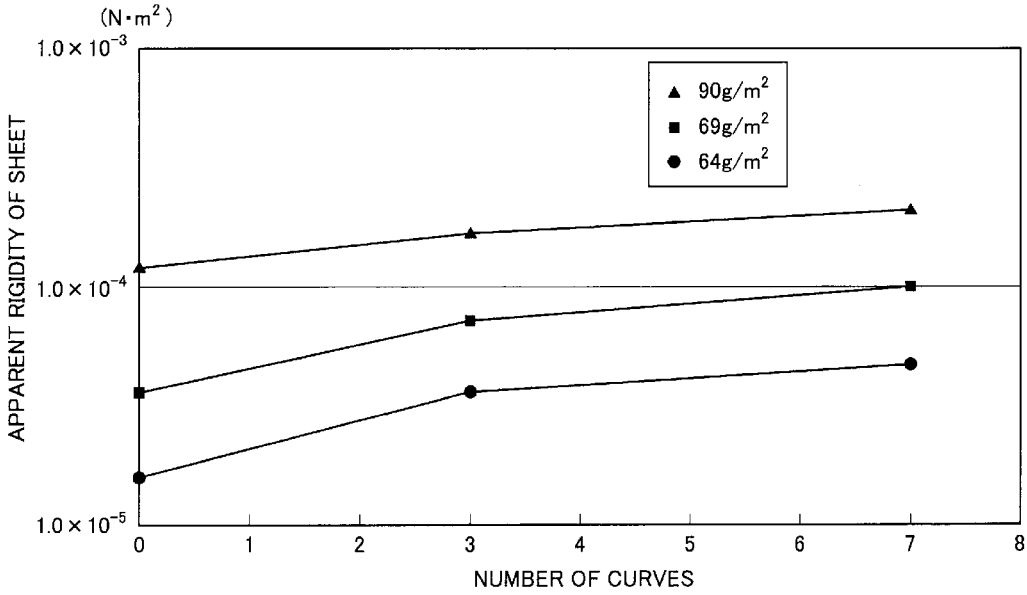
FIG. 12 is a graph illustrating the relationship between the number of curves in the fusing nip and the apparent rigidity of the recording sheet.

FIG. 12 is a graph illustrating the relationship between the number of curves in the fusing nip and the apparent rigidity of the various recording sheets. The vertical axis indicates the apparent rigidity of recording sheet, and the horizontal axis indicates the number of curves in the fusing nip. The number of curves in the fusing nip refers to the number of the positive and negative crown portions. For example, when there are neither the positive crown portions nor the negative crown portions, the number of curves in the fusing nip is zero. When there are three each of the positive crown portions and the negative crown portions, the number of curves in the fusing nip is three. In the graph of FIG. 12, the triangles indicate the measured values for the recording sheet with the basis weight of 90 g/m$^2$; the squares indicate the measured values for the recording sheet with the basis weight of 69 g/m$^2$; and the circles indicate the measured values for the recording sheet with the basis weight of 64 g/m$^2$.

As will be seen from the graph of FIG. 12, in the case of the fusing apparatus whose number of curves in the fusing nip is 3 or 7, the apparent rigidity of the various sheets is larger than in the case of the fusing apparatus whose number of curves in the fusing nip is zero. It is also seen that the apparent rigidity is larger when the number of curves in the fusing nip is 7 than when it is 3. This presumably shows that the effect of increasing the apparent rigidity of the sheet increases as the number of curves in the fusing nip increases. Although the results of the tests shown in FIG. 12 are those of the fusing apparatuses employing a pressing roller, the effect of increasing the apparent rigidity of the recording sheet is believed to be also obtainable in a fusing apparatus having a pressing belt as long as the fusing nip has a concave and convex shape in accordance with an embodiment of the present invention.

Although the invention has been described with reference to particular examples, it will be appreciated by those skilled in the art that the invention may be embodied in many other forms. For example, it is to be appreciated that the fusing apparatus according to an embodiment of the present invention may be used not just in the color image forming apparatus illustrated in FIG. 1 but also in black and white image forming apparatuses, copy machines, printers, facsimile machines, and multifunction peripherals (MFP).

The present application is based on the Japanese Priority Application No. 2009-094011 filed Apr. 8, 2009, the entire contents of which are hereby incorporated by reference.

What is claimed is:

1. A fusing apparatus for fusing a toner image transferred onto a recording medium using heat and pressure, comprising:

a fusing roller;

a heating unit configured to heat the fusing roller;

an endless pressing belt disposed opposite the fusing roller;

a pressing member configured to contact an internal peripheral surface of the endless pressing belt; and a biasing unit configured to apply a biasing force to the pressing member in order to press the pressing member onto the internal peripheral surface of the pressing belt so that the pressing belt can be pressed onto the fusing roller, wherein a fusing nip is formed between the fusing roller and the pressing belt when the pressing belt is pressed onto the fusing roller, wherein the recording medium with the toner image transferred thereon is passed through the fusing nip in order to fuse the toner image onto the recording medium using heat applied to the recording medium via the fusing roller, wherein the fusing roller includes a positive crown portion and a negative crown portion that are alternately formed on a surface of the fusing roller along the axial direction, wherein the pressing member includes a convex surface portion and a concave surface portion that are alternately formed on a surface of the pressing member along the longitudinal direction, wherein, when the pressing member is pressed onto the fusing roller, the positive crown portion of the fusing roller is engaged with the concave surface portion of the pressing member while the negative crown portion of the fusing roller is engaged with the convex surface portion of the pressing member, wherein the pressing force exerted by the pressing member on the fusing roller is greater at a central portion of the fusing nip than at an end portion thereof.

2. The fusing apparatus according to claim 1, wherein the fusing roller has a first reference line substantially parallel to the axis of the fusing roller, while the pressing member has a second reference line that is curved and protruding the most toward the fusing roller at a portion corresponding to the central portion of the fusing nip, the first reference line passing an intermediate position in a diameter direction of the fusing roller between the top of the positive crown portion and the bottom of the negative crown portion along the axial direction, the second reference line passing an intermediate position in a thickness direction of the pressing member between the top of the convex surface portion and the bottom of the concave surface portion along the longitudinal direction.

3. The fusing apparatus according to claim 1, wherein the amounts of protrusion and recess of the top and bottom of the convex and concave surface portions of the pressing member with respect to a first reference line are greater than the amounts of protrusion and recess of the top and bottom of the positive and negative crown portions of the fusing roller with respect to a second reference line, wherein the first reference line passes an intermediate position in a diameter direction of the fusing roller between the top of the positive crown portion and the bottom of the negative crown portion along the axial direction of the fusing roller, and wherein the second reference line passes an intermediate position in a thickness direction of the pressing member between the top of the convex surface portion and the bottom of the concave surface portion along the longitudinal direction of the pressing member.

4. The fusing apparatus according to claim 1, wherein the amounts of protrusion and recess of the top and bottom portions of the convex and concave surface portions of the pressing member with respect to a reference line decrease from a portion of the pressing member corresponding to the central portion of the fusing nip toward an end portion of the fusing nip, wherein the reference line passes an intermediate position in a thickness direction of the pressing member between the top of the convex surface portion and the bottom of the concave surface portion along the longitudinal direction of the pressing member.

5. The fusing apparatus according to claim 1, wherein the amounts of protrusion and recess of the top and bottom of the positive and negative crown portions of the fusing roller decrease from a portion of the fusing roller corresponding to the central portion of the fusing nip toward the end portion, wherein the reference line passes an intermediate position in a diameter direction of the fusing roller between the top and bottom of the positive and negative crown portions along the axial direction of the fusing roller.

6. The fusing apparatus according to claim 1, further comprising:

a first support member configured to support the pressing member; and a second support member configured to receive the biasing force from the biasing unit and configured to support the first support member, wherein the first support member is configured to receive a force from the second support member via a portion of the first support member that corresponds to the central portion of the fusing nip.

7. The fusing apparatus according to claim 6, wherein the first support member is rotatable about an axis located at a point where the first support member receives the force from the second support member.

8. The fusing apparatus according to claim 7, wherein the first support member and the second support member are coupled using a pin disposed at a location corresponding to the central portion of the fusing nip, and wherein the first support member is rotatable about the pin.

9. The fusing apparatus according to claim 7, wherein the second support member includes a protruding portion disposed at a location corresponding to the central portion of the fusing nip, the protruding portion being butted against the first support member, and wherein the first support member is rotatable about the protruding portion.

10. The fusing apparatus according to claim 7, wherein the first support member includes a protruding portion disposed at a location corresponding to the central portion of the fusing nip, the protruding portion being butted against the second support member, wherein the first support member is rotatable about the protruding portion.

11. The fusing apparatus according to claim 1, wherein the pressing member is made of a resilient material softer than the fusing roller.

12. The fusing apparatus according to claim 1, wherein the pressing member has a pressing surface formed in a concave shape in conformity with the outer peripheral surface of the fusing roller.

13. An image forming apparatus having the fusing apparatus according to claim 1.

* * * * *